US005195915A

United States Patent [19]

Namur

[11] Patent Number: 5,195,915

[45] Date of Patent: Mar. 23, 1993

[54] SEALING LIP OF PLASTIC FOR THE LOWER END OF THE INLET OPENING FOR A DAGGER BOARD HOUSING AND DAGGER BOARD, PARTICULARLY OF SAILBOARDS

[76] Inventor: Marc Namur, 1m Harras 10, D-6100 Darmstadt, Fed. Rep. of Germany

[21] Appl. No.: 756,966

[22] Filed: Sep. 9, 1991

[30] Foreign Application Priority Data

Sep. 8, 1990 [DE] Fed. Rep. of Germany ... 9012804[U]
Sep. 21, 1990 [DE] Fed. Rep. of Germany ..... 4029937

[51] Int. Cl.[5] ..... B63B 1/00
[52] U.S. Cl. ..... 441/79; 114/127
[58] Field of Search ..... 277/12, 152, 153, 165; 114/127-141, 39.2, 39.1; 441/74, 79

[56] References Cited

U.S. PATENT DOCUMENTS 3,871,322 3/1975 Dodge ..... 114/127
4,759,308 7/1988 Zander ..... 114/141
4,759,552 7/1988 Schutz ..... 277/152

*Primary Examiner*—Edwin L. Swinehart

*Attorney, Agent, or Firm*—Young & Thompson

[57] ABSTRACT

The lip-type seal for the bottom closure of the inlet opening (2) for dagger board housing (3) and dagger board (4), intended for sailboards, exhibits two mounting strips (6) of a hard plastic with a sealing lip (7) of an elastic plastic, countersunk on both sides of the inlet opening into the board hull (1) and terminating with the profile (5) of the underwater hull. The mounting strip (6) is fashioned as a U-profile with an inner (8) and an outer, short leg (9), these legs being joined by a web (10) extending obliquely in correspondence with the profile (5) of the underwater hull. The sealing lip (7) adjoining the mounting web (10) of the mounting strip (6) has a rounded sealing edge (11) passing over into an elastic supporting leg (12) oriented obliquely upwardly, the supporting leg being attached to the outer leg (9) of the mounting strip (6). The mounting strip (6) is pressed or glued, with the inner leg (8), into a corresponding groove (14) in the board hull (1). The sealing lip (7) forms, together with the supporting leg (12) and the outer leg (9) of the mounting strip (6), an elastic hollow-profile strip (18).

4 Claims, 1 Drawing Sheet

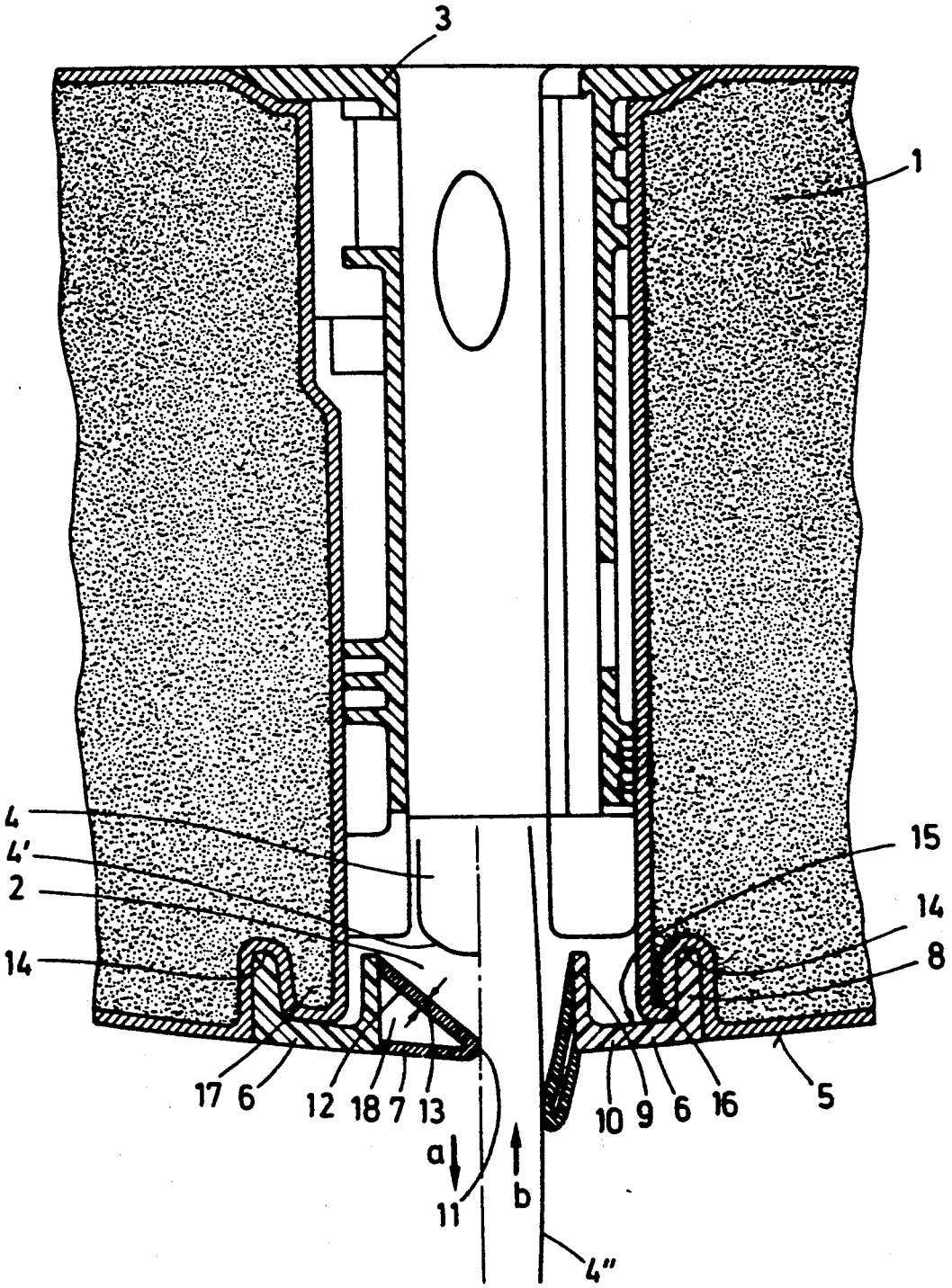
3
1
4
4'
2
14
15
14
8
17
6
12
18
7
13
10
9
6
16
5
a
b
11
4"

SEALING LIP OF PLASTIC FOR THE LOWER END OF THE INLET OPENING FOR A DAGGER BOARD HOUSING AND DAGGER BOARD, PARTICULARLY OF SAILBOARDS

FIELD OF THE INVENTION

The invention relates to a lip-type seal of a synthetic resin for the lower closure of the inlet opening for dagger board housing and dagger board, especially in case of sailboards, with respectively one mounting strip of a hard synthetic resin attached on each side of the inlet opening in the board hull and being flush with the profile of the hull below the waterline, and with a sealing lip of an elastic synthetic resin, produced together with this mounting strip as an extruded profile, wherein the sealing lips form an elastic closure for the inlet opening for dagger board housing and dagger board.

BACKGROUND OF THE INVENTION

It has been found under practical conditions that the sealing action of such a lip-type seal, known from DE 3,629,777 C2, is not optimal. Furthermore, the conventional lip-type seal requires a separate carrier strip, countersunk into the board hull, at which the mounting strip with the sealing lip is clamped in place, so that this lip-type seal is relatively expensive in regard to its structure for sailboards that are manufactured in large series.

SUMMARY OF THE INVENTION

The invention is based on the object of developing a lip-type seal simplified as compared with the lip-type seal of this structure, with an improved sealing effect for the bottom closure of the inlet opening for dagger board housing and dagger board in sailboards.

This object has been attained according to this invention by a lip-type seal having the features of claim 1.

The dependent claims contain suitable embodiments of the invention.

The lip-type seal, fashioned as an elastic hollow-profile strip, is completely tight with an inwardly and outwardly pivoted position of the dagger board, on account of the optimum rigidity of this seal against water pressure. The mounting strip with the sealing lip has a surface favorable from the viewpoint of flow dynamics. The sealing lip, requiring for its mounting to the underwater hull merely a strip integrally formed with the lip, which strip is to be pressed or glued into the board hull, constitutes a simple part which can be produced very economically; this is so, because the mounting strip of a hard plastic, e.g. polyvinyl chloride, and the sealing lip of a soft plastic, e.g. polyurethane, can be extruded simultaneously from these relatively inexpensive materials with an appropriate design of the extruder die, and the two different plastics bond firmly to each other during the curing step.

BRIEF DESCRIPTION OF THE DRAWINGS

The invention will be described in greater detail below with reference to a fragmentary cross-sectional view of a sailboard in the region of the dagger board housing.

DETAILED DESCRIPTION OF THE INVENTION

The lip-type seal for the bottom closure of the inlet opening 2 in the board hull 1 for the dagger board housing 3 inserted from above and for the dagger board 4 exhibits two mounting strips 6 with an elastic sealing lip 7, countersunk on both sides of the inlet opening 2 into the board hull 1 and terminating with the profile 5 of the underwater section of the hull.

The mounting strip 6 is fashioned as a U-profile with an inner 8 and an outer, short leg 9 joined by means of a web 10 extending obliquely in correspondence with the profile 5 of the hull below the waterline. The sealing lip 7 adjoining the connecting web 10 of the mounting strip 6 on the side of the outer leg 9 is shaped, on the longitudinal side facing away from the mounting strip 6, into a rounded sealing edge 11 passing over into an elastic supporting leg 12 oriented obliquely upwardly, this supporting leg being attached to the free terminal edge of the outer leg 9 of the mounting strip 6. The supporting leg 12, more rigid as compared to the sealing lip 7, has a greater thickness 13 than the sealing lip 7.

The mounting strips 6 are pressed or glued into corresponding grooves 14 in the board hull 1 on both sides of the inlet opening 2 by means of the inner leg 8, and the mounting strips are entirely and, respectively, partially in contact, with the inner surface 15 of the connecting web 10, against the rims 16, 17 of the inlet opening 2.

Respectively one mounting strip 6 of a hard plastic, e.g. polyvinyl chloride, and a sealing lip 7 as well as a supporting leg 12 of an elastic synthetic resin, such as polyurethane, are manufactured jointly as an extruded profile.

The sealing lip 7 forms, together with the supporting leg 12 and the outer, short leg 9 of the mounting strip 6, an elastic hollow-profile strip 18, the rigidity of which in the unfolding direction a of the dagger board 4 is lower than in the inward-folding direction b of the dagger board. This mode of action of the sealing lip 7 integrated into the hollow-profile strip 18 ensures that the two sealing lips 7 of the lip-type seal constitute an elastic, tight closure of the opening for accommodating the dagger board housing 3 and the dagger board 4 in the inwardly swung position 4' and in the outwardly swung position 4'' of the dagger board 4; in this connection, the sealing action of the lip-type seal is ensured even in case of a high water pressure resting on the underwater hull during high waves, on account of the stiffening of the sealing lips 7 with the aid of the supporting legs 12. The stiffness of the sealing lip 7 reduced in the unfolding direction a of the dagger board 4 ensures a central smooth operation of the dagger board 4 so that the manual strength required for unfolding the dagger board can be generated by any sailboarder, and the operating force, increasing during the inward folding of the dagger board on account of the higher rigidity of the sealing lips 7 in the inward-folding direction b, can be readily applied by any surfer due to the possibility of manipulating the dagger board with one's foot.

In case of damage to a sealing lip 7, the mounting strip 6 can be detached with the inner leg 8 from the groove 14 in the board 1 and can be exchanged.

I claim:

1. A lip seal assembly for the bottom closure of an inlet opening in a board hull for dagger board housing and dagger board, comprising: one mounting strip of a hard synthetic resin attached respectively on each side of the inlet opening in the board hull and being flush with the profile of the hull below the waterline, and a sealing lip of an elastic synthetic resin, produced together with said mounting strip as an extruded profile, said sealing lips forming an elastic closure for the inlet opening for dagger board housing and dagger board, said mounting strip exhibiting a U-profile with an inner and an outer, short leg, said legs being joined by means of a connecting web, said sealing lip adjoining the connecting web of the mounting strip on the side of the outer leg and being formed, on a longitudinal side facing away from the mounting strip, into a rounded sealing edge, said rounded sealing edge passing over into an elastic supporting leg oriented obliquely upwardly, said supporting leg being attached to a free terminal edge of the outer leg of the mounting strip and constituting with said outer leg and said sealing lip an elastic hollow-profile strip; and said mounting strip being attached with the inner leg in a corresponding groove in the board hull, whereby the inner surface of the connecting web contacts entirely or partially a rim of the inlet opening.

2. The lip seal assembly according to claim 1, wherein the mounting strip is pressed with the inner leg into the groove in the board hull.

3. The lip seal assembly according to claim 1, wherein the mounting strip is glued with the inner leg into the groove in the board hull.

4. The lip seal assembly according to claim 1, wherein the supporting leg, is more rigid than the sealing lip, and has a larger thickness than the sealing lip.

* * * * *